US007509696B2

(12) United States Patent
Soto et al.

(10) Patent No.: US 7,509,696 B2
(45) Date of Patent: Mar. 31, 2009

(54) SYSTEM, METHOD, AND APPARATUS FOR A RETRACTABLE AND CONCEALABLE SUPPORT FOR AN ITEM OF FURNITURE

(76) Inventors: Oscar Q. Soto, 2607 Keith, Amarillo, TX (US) 79110; Richard Herrera, 734 N. Aldredge, Amarillo, TX (US) 79107

( * ) Notice: Subject to any disclaimer, the term of this patent is extended or adjusted under 35 U.S.C. 154(b) by 369 days.

(21) Appl. No.: 11/455,327

(22) Filed: Jun. 19, 2006

(65) Prior Publication Data

US 2006/0288482 A1 Dec. 28, 2006

Related U.S. Application Data

(60) Provisional application No. 60/692,762, filed on Jun. 22, 2005.

(51) Int. Cl.
*A47C 21/00* (2006.01)
*A47B 3/14* (2006.01)
*A47B 23/00* (2006.01)

(52) U.S. Cl. ..... 5/507.1; 5/21; 297/144; 297/423.22; 297/423.23; 108/49

(58) Field of Classification Search ..... 5/507.1, 5/503.1, 658, 2.1, 17, 18.1, 21, 41; 297/144, 297/154, 170, 174 R, 188.1, 423.2, 423.22, 297/423.23; 108/49
See application file for complete search history.

(56) References Cited

U.S. PATENT DOCUMENTS

| | | | | | |
|---|---|---|---|---|---|
| 119,344 | A | | 9/1871 | Glynn et al. | |
| 272,434 | A | | 2/1883 | Hathaway | |
| 371,373 | A | * | 10/1887 | Scarritt | 297/423.23 |
| 378,996 | A | | 3/1888 | Alden | |
| 507,270 | A | * | 10/1893 | Hirschfeld | 297/423.22 |
| 562,920 | A | * | 6/1896 | Salquist | 297/105 |
| 576,480 | A | * | 2/1897 | Stern | 297/265.1 |
| 640,647 | A | | 1/1900 | Gannett | |
| 710,321 | A | * | 9/1902 | Grosjean | 297/423.22 |
| 777,965 | A | * | 12/1904 | Linsmayer | 5/21 |
| 778,074 | A | * | 12/1904 | Saffell | 297/423.22 |
| 990,055 | A | * | 4/1911 | Lightner | 108/152 |
| 1,231,678 | A | * | 7/1917 | Walker | 108/49 |
| 1,248,842 | A | * | 12/1917 | Gaver | 108/8 |
| 1,301,835 | A | * | 4/1919 | Glenister | 297/320 |
| 1,348,481 | A | * | 8/1920 | Chomos | 5/507.1 |
| 1,386,819 | A | * | 8/1921 | Walton | 297/423.22 |
| 1,484,337 | A | * | 2/1924 | Morlock et al. | 5/21 |
| 1,489,101 | A | * | 4/1924 | Sefl | 297/144 |
| 1,662,675 | A | * | 3/1928 | Innes | 108/5 |

(Continued)

FOREIGN PATENT DOCUMENTS

EP 1 254 617 A2 6/2002

(Continued)

*Primary Examiner*—Robert G Santos
(74) *Attorney, Agent, or Firm*—Bracewell & Giuliani LLP

(57) ABSTRACT

A device for providing a dining support that is extendable from and retractable and concealable on furniture is disclosed. The device has a platform that is movable between a deployed position for supporting food and drinks, and a retracted position beneath the furniture. To move device from the retracted position to the deployed position, the platform is pulled from beneath the furniture and then elevated to a horizontal position. The height of the platform is vertically adjustable.

16 Claims, 7 Drawing Sheets

U.S. PATENT DOCUMENTS

| | | | | | |
|---|---|---|---|---|---|
| 1,684,936 | A | * | 9/1928 | Allemeier | 5/21 |
| 1,737,604 | A | * | 12/1929 | Martin | 5/21 |
| 1,835,772 | A | * | 12/1931 | Ginsberg | 297/144 |
| 1,849,023 | A | * | 3/1932 | Martin | 5/20 |
| 1,862,237 | A | * | 6/1932 | Pepler | 108/49 |
| 1,930,882 | A | * | 10/1933 | McRae | 108/49 |
| 2,051,959 | A | * | 8/1936 | Martin | 5/21 |
| 2,139,923 | A | * | 12/1938 | Woller | 5/26.1 |
| 2,150,879 | A | * | 3/1939 | Fox | 5/21 |
| 2,162,146 | A | * | 6/1939 | Wesley | 5/21 |
| 2,163,349 | A | | 6/1939 | Olsen | |
| 2,167,175 | A | * | 7/1939 | Fox | 5/21 |
| 2,185,813 | A | * | 1/1940 | Johnson | 297/423.23 |
| 2,193,647 | A | * | 3/1940 | Rush et al. | 108/49 |
| 2,238,765 | A | * | 4/1941 | Woller | 5/21 |
| 2,328,411 | A | * | 8/1943 | Bergstrom | 5/48 |
| 2,460,244 | A | * | 1/1949 | Strauss | 108/137 |
| 2,555,144 | A | * | 5/1951 | Londerman et al. | 297/119 |
| 2,557,692 | A | * | 6/1951 | Robinson | 5/21 |
| 2,582,703 | A | * | 1/1952 | Kirshbaum | 297/144 |
| 2,604,146 | A | * | 7/1952 | Martin | 297/423.22 |
| 2,607,048 | A | * | 8/1952 | Unterhalter | 5/20 |
| 2,635,680 | A | | 4/1953 | Zentmire | |
| 2,709,818 | A | * | 6/1955 | Freese | 5/507.1 |
| 2,712,655 | A | * | 7/1955 | Hatton | 5/21 |
| 2,760,210 | A | * | 8/1956 | Bebry | 5/21 |
| 2,845,114 | A | * | 7/1958 | Edwards | 297/173 |
| 3,618,145 | A | * | 11/1971 | Rowe | 5/507.1 |
| 3,717,375 | A | * | 2/1973 | Slobodan | 297/162 |
| 3,855,650 | A | * | 12/1974 | Neunherz et al. | 5/21 |
| 3,957,302 | A | | 5/1976 | Jones | |
| 4,341,418 | A | | 7/1982 | Chappell | |
| 4,359,004 | A | * | 11/1982 | Chappell | 108/44 |
| 4,672,696 | A | * | 6/1987 | Horenkamp | 5/17 |
| 5,035,464 | A | | 7/1991 | Spallholtz | |
| 5,129,702 | A | | 7/1992 | Ervin | |
| 5,322,344 | A | | 6/1994 | Hoffman et al. | |
| 5,375,907 | A | | 12/1994 | Rogers et al. | |
| 5,524,957 | A | | 6/1996 | Gibriano | |
| 5,586,806 | A | | 12/1996 | Hergott | |
| 6,520,586 | B2 | | 2/2003 | Park | |
| 6,588,837 | B1 | * | 7/2003 | Schultz et al. | 297/111 |
| 2006/0288482 | A1 | * | 12/2006 | Soto et al. | 5/507.1 |

FOREIGN PATENT DOCUMENTS

| | | | | |
|---|---|---|---|---|
| GB | 2187086 | A | * | 9/1987 |
| JP | 10215980 | A | | 8/1998 |

* cited by examiner

SYSTEM, METHOD, AND APPARATUS FOR A RETRACTABLE AND CONCEALABLE SUPPORT FOR AN ITEM OF FURNITURE

This utility patent application claims priority to and the benefit of U.S. Provisional Patent Application Ser. No. 60/692,762, filed on Jun. 22, 2005, and is incorporated herein by reference in its entirety.

BACKGROUND OF THE INVENTION

1. Technical Field

The present invention relates in general to an auxiliary support structure for furniture and, in particular, to an improved system, method, and apparatus for providing a food and/or beverage support device for dining that is extensible from and retractable and concealable on an item of furniture.

2. Description of the Related Art

In the prior art, storable folding tables or support surfaces (also known as "TV trays" or "television trays") for use with arm chairs, couches, hospital beds, and the like have been known and used for many years. Such tables are typically used for positioning food and drink items on the tables or as writing surfaces, while a person is comfortably seated on the furniture. Some of the disadvantages associated with earlier designs of these types of tables is their overall instability, and their inability to be adjusted by the user to allow the user to do different types of activities such as writing, reading, etc.

For example, furniture having folding or collapsible armrests have been known. See, U.S. Pat. Nos. 1,399,744, 2,409,316, and 4,938,534. Other patents disclose chairs or seats equipped with armrests that are collapsible or retractable. Another example discloses a folding theater seat equipped with a movable armrest. While the armrest can be positioned in a storage box, the seat is preformed as part of an array of seats and is difficult to use with individual seats. More recent examples include U.S. Pat. Nos. 6,520,586, 5,586,806, 5,524,957, 5,129,702, 5,322,344, 5,375,907, and 5,035,464. Although each of these designs is workable, an improved solution for a portable and stowable tray for use with living room furniture would be desirable.

SUMMARY OF THE INVENTION

One embodiment of a system, method, and apparatus for providing a dining support device that is extensible from and retractable and concealable on an item of furniture. The device has a platform that is movable between a deployed position for supporting food, drinks, etc., and a retracted position beneath the item of furniture. To move the device from the retracted position to the deployed position, the platform is pulled from beneath the furniture and then elevated to a horizontally extended position.

The device be provided as original equipment on furniture or installed on existing furniture. The height of the platform is vertically adjustable when the platform is in the elevated position to accommodate the preferences of various users. This adjustability gives the invention flexibility to be used as a food and beverage service device, a work surface, a reading or writing surface, etc.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the invention, as well as others which will become apparent are attained and can be understood in more detail, more particular description of the invention briefly summarized above may be had by reference to the embodiment thereof which is illustrated in the appended drawings, which drawings form a part of this specification. It is to be noted, however, that the drawings illustrate only an embodiment of the invention and therefore are not to be considered limiting of its scope as the invention may admit to other equally effective embodiments.

DETAILED DESCRIPTION OF THE INVENTION

Figure 1:
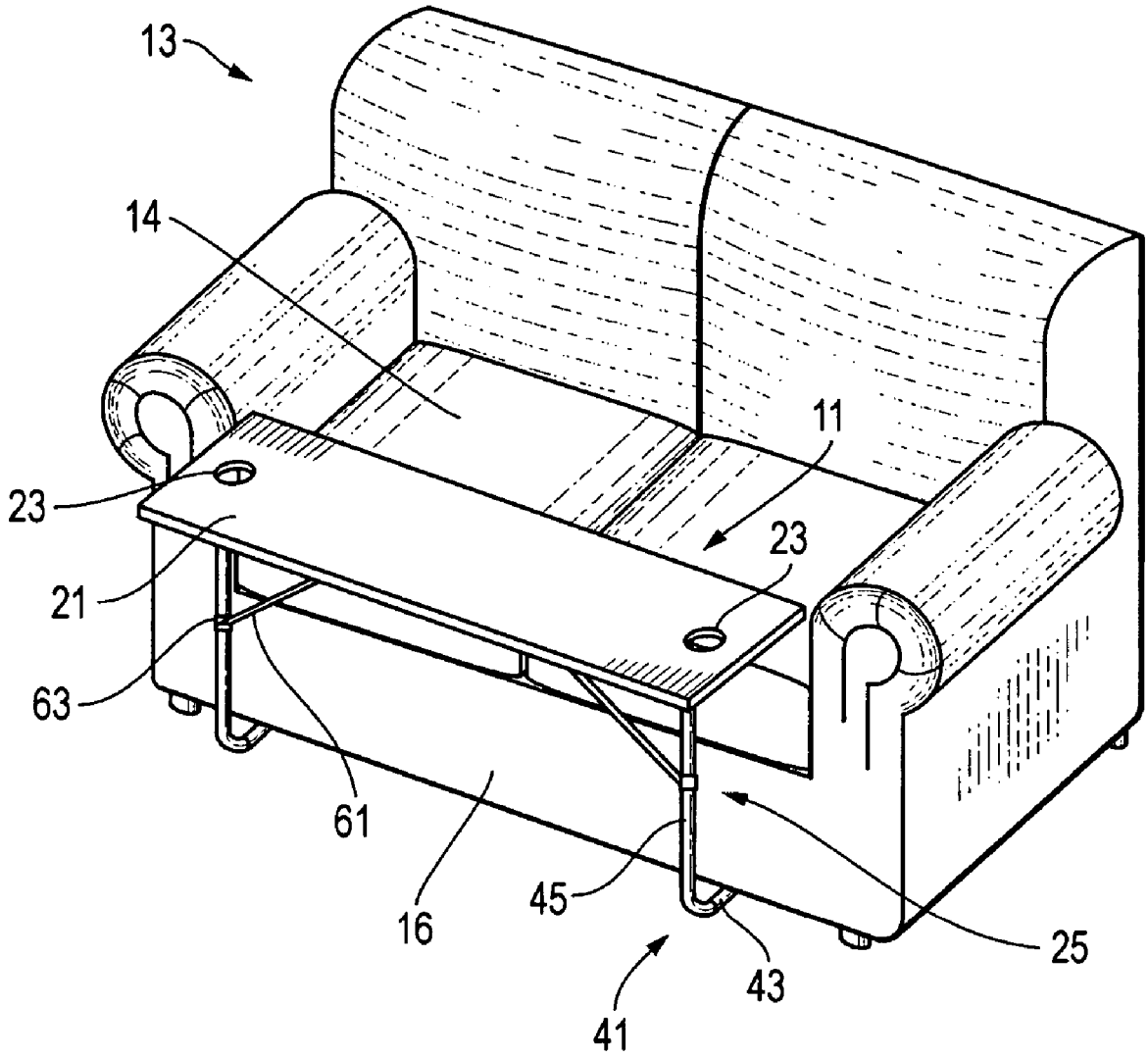
FIG. 1 is a top isometric view of one embodiment of a support device constructed in accordance with the present invention, and is shown in a fully deployed position.
Figure 2:
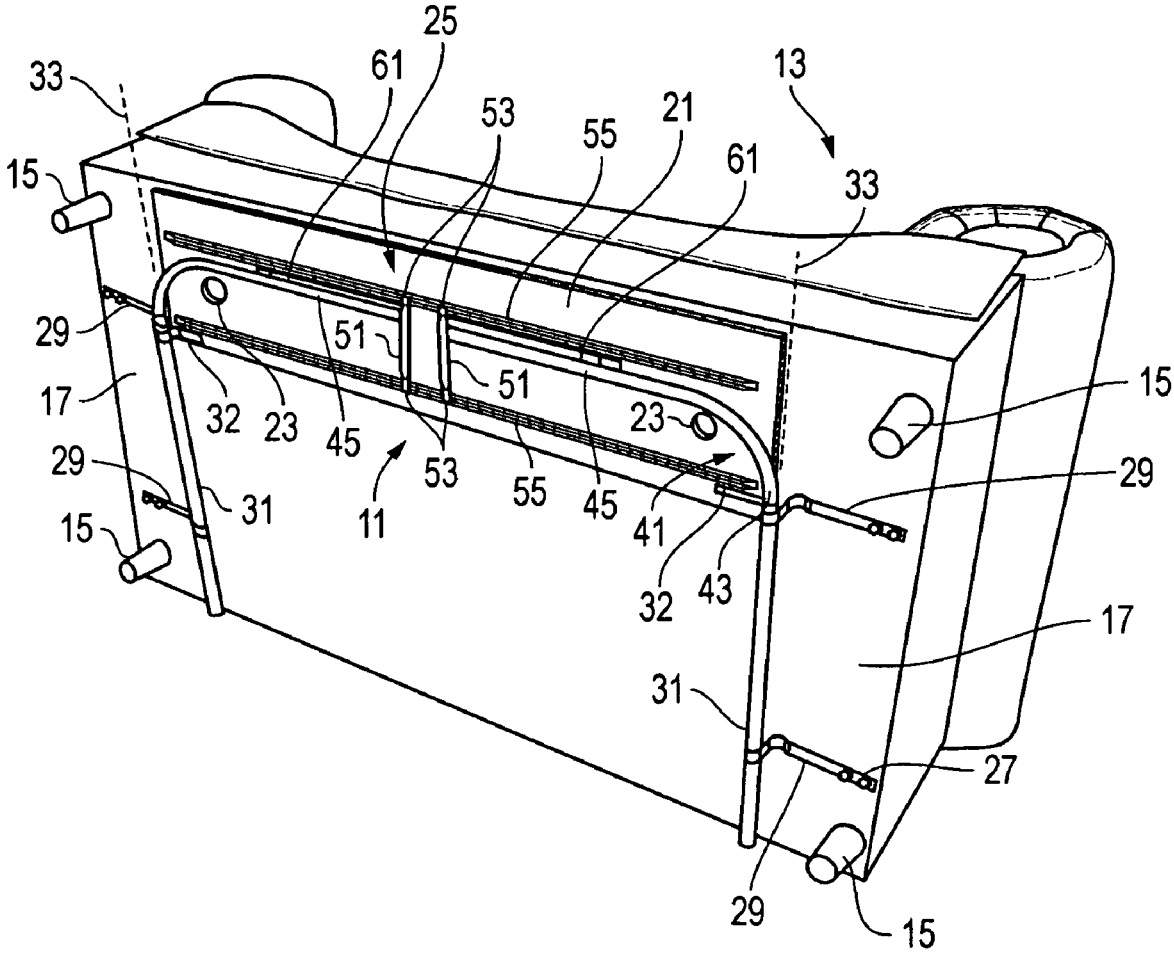
FIG. 2 is a bottom isometric view of the support device of FIG. 1 and is shown in a fully retracted position.
Figure 3:
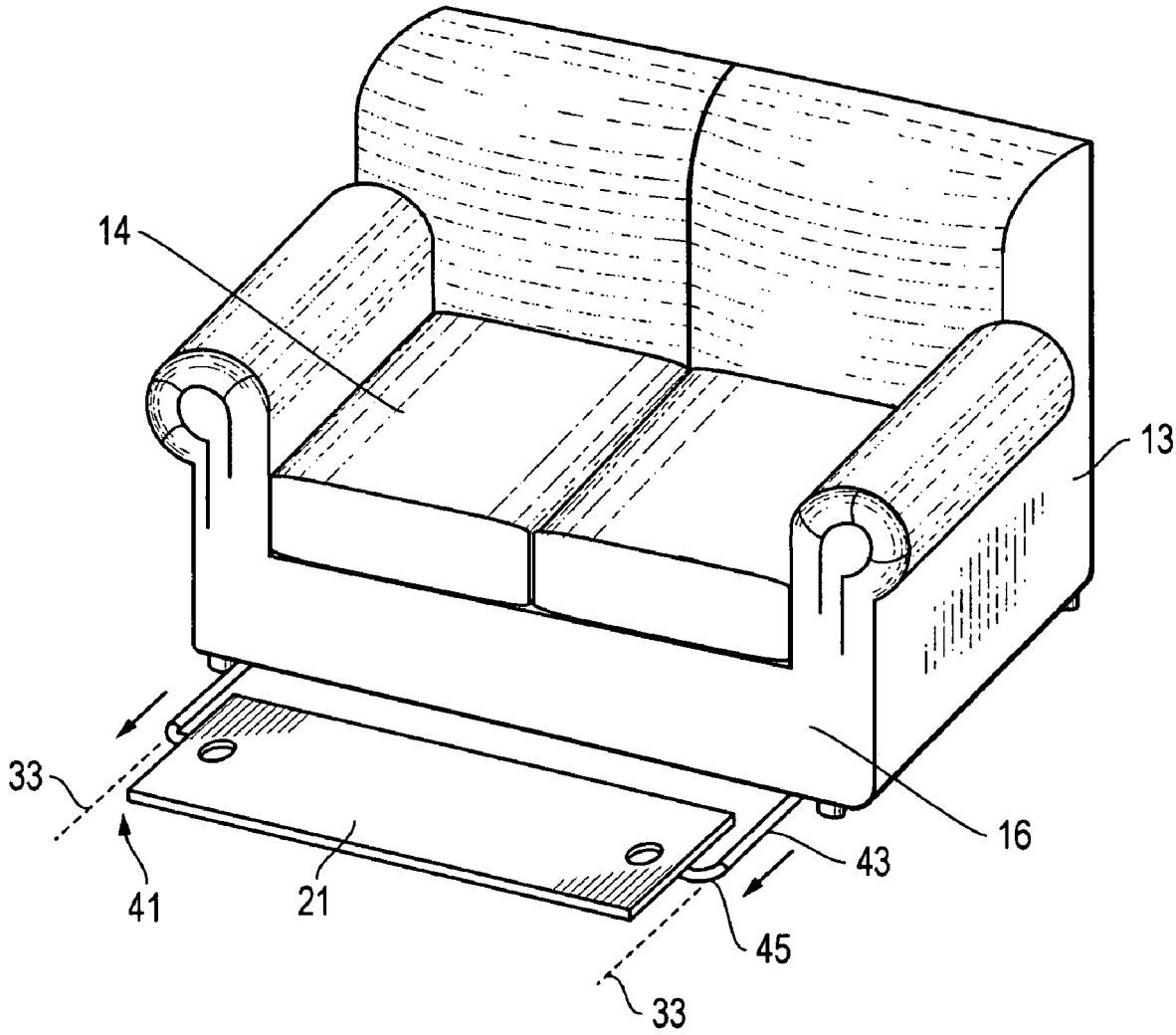
FIG. 3 is a top isometric view of the support device of FIG. 1 and is shown being moved forward to a horizontally extended position.
Figure 4:
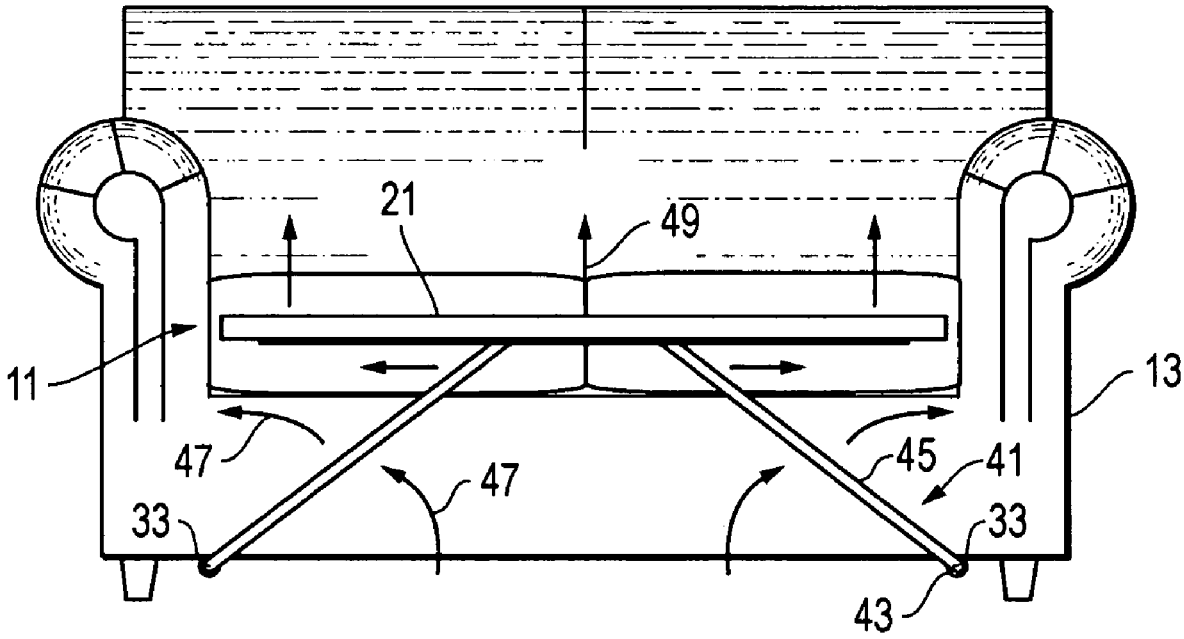
FIG. 4 is a front view of the support device of FIG. 1 and is shown being lifted to a vertically elevated position.

Referring to FIGS. 1-7, one embodiment of a system, method, and apparatus for providing a support device 11 that is extensible from and retractable and concealable on an item of furniture 13 is shown. The present invention is ideally suited for supporting food and/or beverages such as is commonly done via a portable "television tray" or "TV tray." However, unlike a conventional TV tray, the present invention may be permanently mounted to an item of furniture, such as a sofa, couch, loveseat, etc., so that it can be quickly and easily stored or stowed beneath the item of furniture (FIG. 2). An item of furniture 13 typically includes a seating surface 14 for supporting a user thereon, a lower surface 17 located below the seating surface 14 and facing a floor on which the furniture 13 is located, and a front 16, typically located between the seating surface 14 and the lower surface 17 along a forward portion of the furniture 13.

Typically, the legs 15 of furniture 13 provide sufficient clearance (both vertical and horizontal) between the bottom of furniture 13 and the underlying floor or support surface beneath furniture 13 to allow device 11 to move freely. Device 11 requires no more than about three or four inches of such vertical clearance. When properly stored beneath the item of furniture, the present invention is substantially undetectable to a casual observer since it is completely collapsible and retractable as will be described below.

In FIG. 1, the device 11 is shown in a fully deployed position that is ready for use by a user (FIG. 7) seated on furniture 13. In the embodiment shown, device 11 includes a planar support platform 21 having one or more optional cup holders 23. Platform 21 is generally rectangular and is formed from materials and has sufficient thickness for strength and durability, while remaining relatively lightweight for ease of use. In one embodiment, a width of the platform 21 is substantially equal to a width of the seating surface 14 of the furniture 13 Cup holders 23 may comprise many different forms in platform 21, including recesses, through holes, and other cup-supporting structures of various shapes and sizes.

Platform 21 is supported by an undercarriage or frame 25 upon which it is moved between all of the positions of device 11 while remaining substantially parallel to the floor. As best shown in FIG. 2, frame 25 is permanently secured to the bottom of furniture 13. In the embodiment shown, device 11 is fastened directly to the frame 17 of the furniture 13 with fasteners 27 such as screws or bolts. Frame 25 uses support brackets 29 that extend inward from furniture frame 17 toward each other to a pair of base pipes 31. Base pipes 31 are rigid and immovable relative to furniture frame 17 and define horizontal axes 33 (FIGS. 2 and 3) that extend forward therefrom. Each base pipe 31 also has a platform support 32 (FIG. 2) that further supports and immobilizes the platform 21 when device 11 is in the fully retracted position.

An L-shaped leg 41 is movably mounted to each base pipe 31. Each leg 41 has a horizontal lower portion 43 and an upper portion 45. The lower portions 43 are slidably and telescopically mounted inside base pipes 31 for horizontal movement forward and rearward along axes 33. Lower portions 43 are not permitted to completely exit base pipes 31. The upper portions 45 are pivotable about axes 33. When upper portions 45 are pivoted away from each other (see arrows 47 in FIG. 4), platform 21 is lifted or vertically elevated, as shown at arrows 49. However, when upper portions 45 are pivoted toward each other, platform 21 is vertically lowered.

Figure 5:
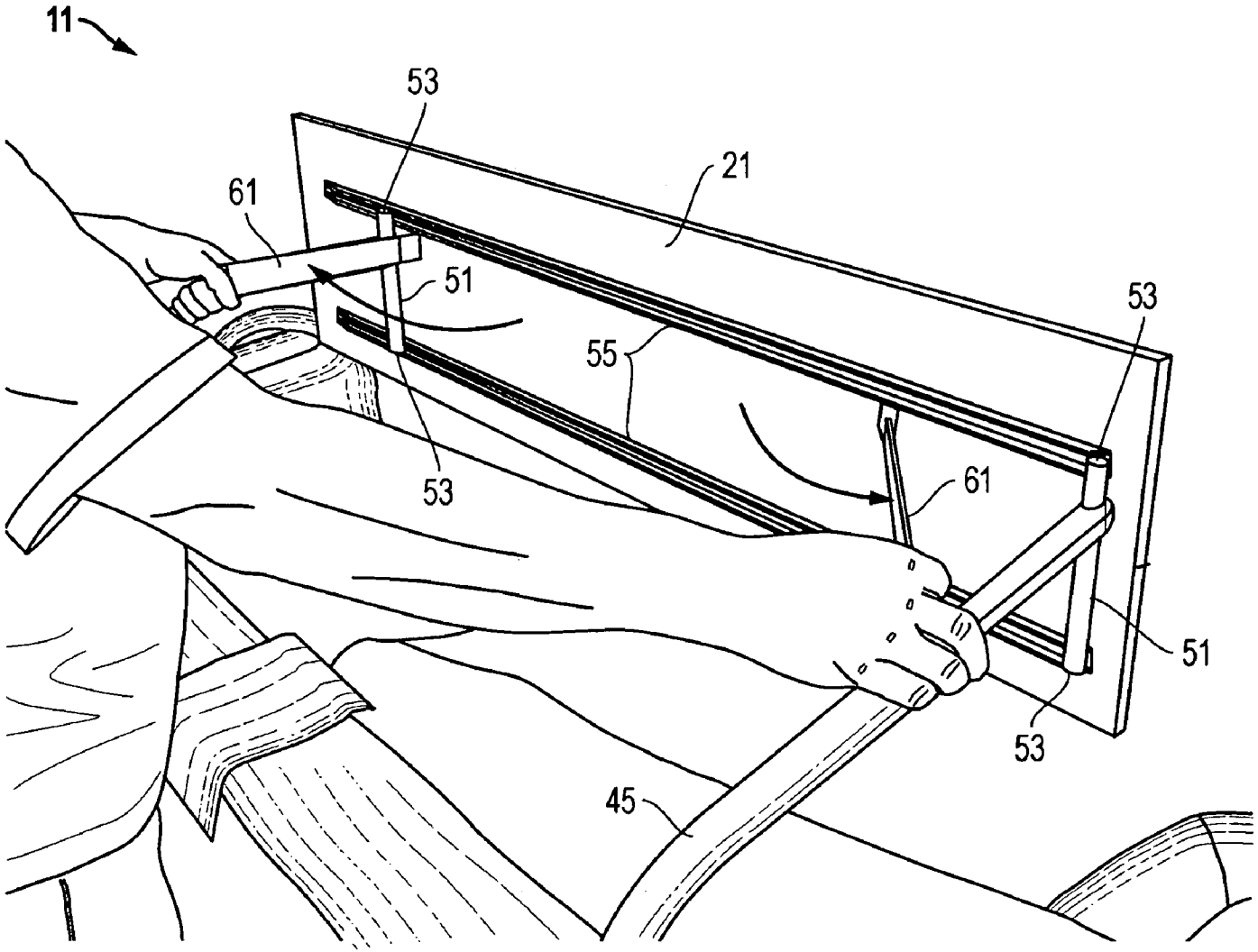
FIG. 5 is a bottom isometric view of the support device of FIG. 1 and is shown being moved to an adjustably secured position.

As shown in FIGS. 2 and 5, the upper ends of upper portions 45 are pivotally mounted (e.g., via a hinge) to a brace 51. Each brace 51 has a pair of pins 53 (one on each end) that slide inside a pair of tracks 55 mounted to the underside of platform 21. Tracks 55 capture pins 53 in such a manner as to limit their movement to lateral sliding (e.g., left to right and right to left). Pins 53 are not permitted to exit tracks 55.

Figure 6:
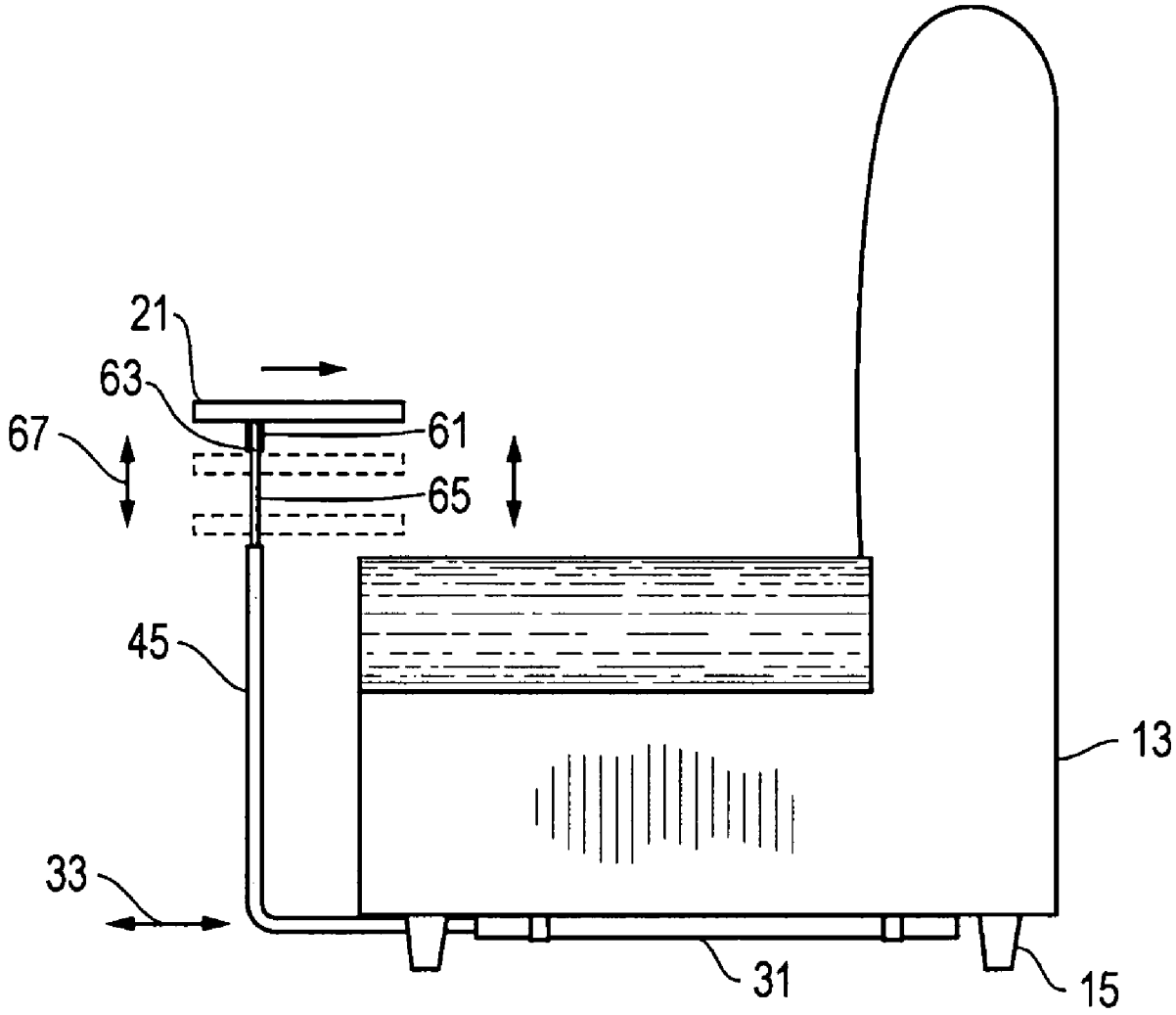
FIG. 6 is a side view of the support device of FIG. 1 and is shown being moved in a horizontally movable position wherein a support surface is also vertically adjustable.
Figure 7:
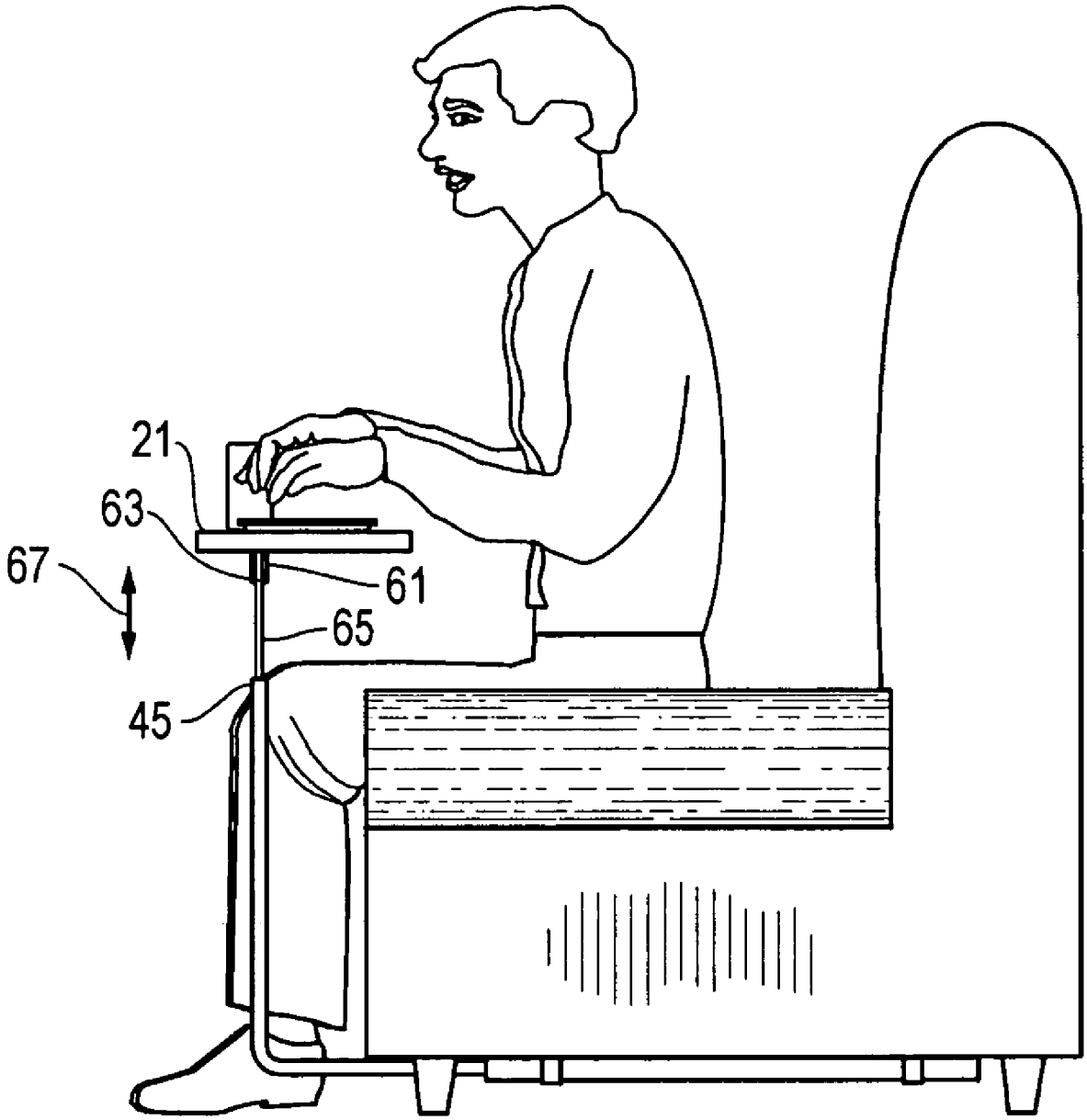
FIG. 7 is a side view of the support device of FIG. 1 and is shown in the fully deployed position wherein the support surface remains vertically adjustable.

When upper portions 45 are pivoted fully outward (FIG. 5) and vertically upright, and braces 51 are in their outermost positions, a pair of pivotable struts 61 are lowered from the underside of platform 21 and used to secure platform 21 in a usable configuration (FIGS. 1, 6, and 7). Each strut 61 is hinged to platform 21 for movement between a horizontal stored position (FIG. 2), wherein hinges 61 are captured between platform 21 and upper portions 45, and a diagonal reinforcement position (FIGS. 1 and 5).

In the diagonal reinforcement position, the distal ends of struts 61 are releasably secured to upper portions 45 via, for example, fasteners 63 (FIG. 1). For example, fasteners 63 may comprise spring pins and receptacles, etc. With struts 61 secured via fasteners 63, upper portions 45 are prevented from rotation about axes 33. The struts 61 may also work in conjunction with a pair of elevational rods 65 (FIGS. 6 and 7) that are located inside upper portions 45. The upper ends of rods 65 are pivotally secured to braces 51, and the lower ends of rods 65 located in upper portions 45. Rods 65 are not permitted to exit upper portions 45. However, rods 65 are slidably telescopic and permit the vertical elevation of platform 21 to be adjusted (see arrow 67) in a variety of positions. Fasteners 63 provide numerous corresponding points of attachment along upper portions 45 for struts 61 to secure these structural elements in place.

In operation, device 11 is sold either as original equipment on an item of furniture, or as a stand-alone kit that is installed on an existing or conventional item of furniture. Either way (after installation), device 11 is movable between an operational or fully deployed position (FIG. 1), and a non-operational, stored, or fully retracted position (FIG. 2). To move device 11 from the fully retracted position to the fully deployed position, the platform 21 is pulled from beneath the furniture 13 to a horizontally extended position (FIG. 3) by sliding lower portions 43 out of base pipes 31.

Next, platform 21 is lifted and upper portions 45 are pivoted outward (FIG. 4) to a vertically elevated position until they are vertical and upright. As shown in FIG. 5, the struts 61 are then pivoted and locked in adjustably secured positions. As suggested previously, the vertical elevation of the platform 21 may be adjusted via rods 65 (FIG. 6) while in a horizontally movable position, or in the fully deployed position (FIG. 7).

The present invention has several advantages, including the ability to be fabricated as original equipment on an item of furniture, or to be fabricated as a kit that is adaptable to be installed on conventional furniture. The height of the support surface is vertically adjustable when the apparatus is in the elevated position to accommodate the preferences of various users. This adjustability gives the present invention flexibility to be used as a food and beverage service device, a work surface, a reading or writing surface, etc.

While the invention has been shown or described in only some of its forms, it should be apparent to those skilled in the art that it is not so limited, but is susceptible to various changes without departing from the scope of the invention. For example, an optional handle may be mounted to the platform to help facilitate its movement, such as to the forward or leading edge of the platform. Such a handle also may display a logo or other indicia of identification for the device. In one embodiment, the platform is horizontal at all times and throughout a range of movement between the retracted and extended positions. When moving from the retracted position to the extended position, the platform moves forward and then upward, and when moving from the extended position to the retracted position, the platform moves downward and then rearward.

What is claimed is:

1. A system of accommodating a furniture user, comprising:

an item of furniture having a seating surface adapted to support a user thereon, a lower surface located below the seating surface and adapted to face a floor on which the furniture is located, a vertical clearance defined between the lower surface and the floor, and a front located between the seating surface and the lower surface along a forward portion of the furniture;

a support device having a retracted position located in the vertical clearance such that the support device is substantially concealed, and an extended position elevated above the retracted position adjacent the seating surface at the front of the furniture; the support device further comprising:

a frame mounted to the lower surface of the furniture and a platform mounted to the frame, and the platform is horizontal at all times and throughout a range of movement between the retracted and extended positions;

a leg movably mounted to each base pipe, each leg having a lower portion and an upper portion, such that the lower portions are slidably and telescopically mounted inside the base pipes for horizontal movement forward and rearward along the horizontal axes; and wherein the upper portions have upper ends that are pivotally mounted to a brace, each brace has a pair of pins that slide inside a pair of tracks mounted to an underside of the platform, and the tracks capture the pins to movement of the pins to lateral sliding.

2. A system according to claim 1 wherein, when moving from the retracted position to the extended position, the platform moves forward and then upward, and when moving from the extended position to the retracted position, the platform moves downward and then rearward.

3. A system according to claim 1 wherein a width of the platform is substantially equal to a width of the seating surface, and the platform has at least one cup holder.

4. A system according to claim 1 wherein the frame is secured directly to a furniture frame and secured thereto with support brackets that extend inward from the furniture frame toward each other to a pair of base pipes, the base pipes being rigid and immovable relative to the furniture frame to define horizontal axes that extend forward therefrom.

5. A system according to claim 4, wherein each base pipe has a platform support that supports and immobilizes the platform in the retracted position.

6. A system according to claim 1, wherein the lower portions are not permitted to completely exit the base pipes, and the upper portions are pivotable about the horizontal axes.

7. A system according to claim 1, wherein, when moving to the extended position, the upper portions pivot away from each other such that the platform is vertically elevated and, when moving to the retracted position, the upper portions pivot toward each other such that the platform is vertically lowered.

8. A system according to claim 1, wherein when the upper portions are pivoted fully outward and vertically upright, and the braces are in an outermost positions, a pair of pivotable struts are lowered from the underside of the platform to secure the platform in the extended position.

9. A system according to claim 8, wherein each strut is hinged to the platform for movement between a horizontal stored position wherein the hinges are captured between the platform and the upper portions, and a diagonal reinforcement position wherein distal ends of the struts are releasably secured to the upper portions such that the upper portions are prevented from rotation about the horizontal axes.

10. A system according to claim 9, further comprising elevational rods located inside the upper portions, such that upper ends of the elevational rods are pivotally secured to the braces, and lower ends of the elevational rods are located in the upper portions, and the elevational rods are slidably telescopic and permit the vertical elevation of the platform to be adjusted in a variety of positions.

11. A support device for an item of furniture, comprising:

a platform having a retracted position adapted to be located and substantially concealed beneath the furniture, and an extended position elevated above the retracted position and adapted to be located adjacent a seating surface of the furniture at a front of the furniture;

a frame adapted to be mounted to the furniture therebelow for supporting the platform, the frame having base pipes that are immovable relative to the furniture to define horizontal axes that extend forward therefrom, and each base pipe having a platform support that supports and immobilizes the platform in the retracted position;

a leg movably mounted to each base pipe, each leg having a lower portion and an upper portion, such that the lower portions are slidably and telescopically mounted inside the base pipes for horizontal movement forward and rearward along the horizontal axes; and wherein the upper portions have upper ends that are pivotallv mounted to a brace, each brace has a pair of pins that slide inside a pair of tracks mounted to an underside of the platform, and the tracks capture the pins to movement of the pins to lateral sliding.

12. A support device according to claim 11 wherein, when moving from the retracted position to the extended position, the platform moves forward and then upward, and when moving from the extended position to the retracted position, the platform moves downward and then rearward;

the platform is horizontal at all times and throughout a range of movement between the retracted and extended positions;

a width of the platform is substantially equal to a width of the seating surface; and the platform has at least one cup holder.

13. A support device according to claim 11, wherein the lower portions are not permitted to completely exit the base pipes, and the upper portions are pivotable about the horizontal axes.

14. A support device according to claim 11, wherein, when moving to the extended position, the upper portions pivot away from each other such that the platform is vertically elevated and, when moving to the retracted position, the upper portions pivot toward each other such that the platform is vertically lowered.

15. A support device according to claim 11 wherein when the upper portions are pivoted fully outward and vertically upright, and the braces are in an outermost positions, a pair of pivotable struts are lowered from the underside of the platform to secure the platform in the extended position.

16. A support device according to claim 15, wherein each strut is hinged to the platform for movement between a horizontal stored position wherein the hinges are captured between the platform and the upper portions, and a diagonal reinforcement position wherein distal ends of the struts are releasably secured to the upper portions such that the upper portions are prevented from rotation about the horizontal axes; and further comprising elevational rods located inside the upper portions, such that upper ends of the elevational rods are pivotally secured to the braces, and lower ends of the elevational rods are located in the upper portions, and the elevational rods are slidably telescopic and permit the vertical elevation of the platform to be adjusted in a variety of positions.

* * * * *